US007371986B2

(12) United States Patent
Varland et al.

(10) Patent No.: US 7,371,986 B2
(45) Date of Patent: May 13, 2008

(54) PUSHBUTTON WITH REPLACEABLE MODE CAM

(75) Inventors: Elsa J. Varland, Lake Geneva, WI (US); Darrell S. Filtz, Cedarburg, WI (US); Frank J. Graninger, Wind Lake, WI (US); Jie Ning, Shorewood, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 36 days.

(21) Appl. No.: 11/214,297

(22) Filed: Aug. 29, 2005

(65) Prior Publication Data

US 2007/0045097 A1 Mar. 1, 2007

(51) Int. Cl.
*H01H 13/14* (2006.01)

(52) U.S. Cl. ..... 200/520; 200/341

(58) Field of Classification Search ..... 200/520, 200/11 TW

See application file for complete search history.

(56) References Cited

U.S. PATENT DOCUMENTS

| | | | | |
|---|---|---|---|---|
| 4,404,445 | A | 9/1983 | Baran et al. | |
| 4,724,286 | A | 2/1988 | Cummins | |
| 5,264,821 | A * | 11/1993 | Vultaggio et al. | 338/172 |
| 5,945,647 | A * | 8/1999 | Hoskins | 200/18 |
| 6,130,386 | A | 10/2000 | Jorczak | |
| 6,570,105 | B1 * | 5/2003 | Sallam et al. | 200/4 |
| 6,794,770 | B2 | 9/2004 | Kirby | |
| 2007/0029173 | A1 * | 2/2007 | Sato | 200/1 R |

OTHER PUBLICATIONS

PCT Search Report for PCT/US06/33719.

* cited by examiner

*Primary Examiner*—Elvin Enad
*Assistant Examiner*—Lheiren Mae A. Anglo
(74) *Attorney, Agent, or Firm*—Keith M. Baxter; Alexander R. Kuszewski

(57) ABSTRACT

A pushbutton provides an operator with a replaceable cam ring that converts the operating mode of the operator from push-pull to twist-to-release.

18 Claims, 4 Drawing Sheets

FIG. 1
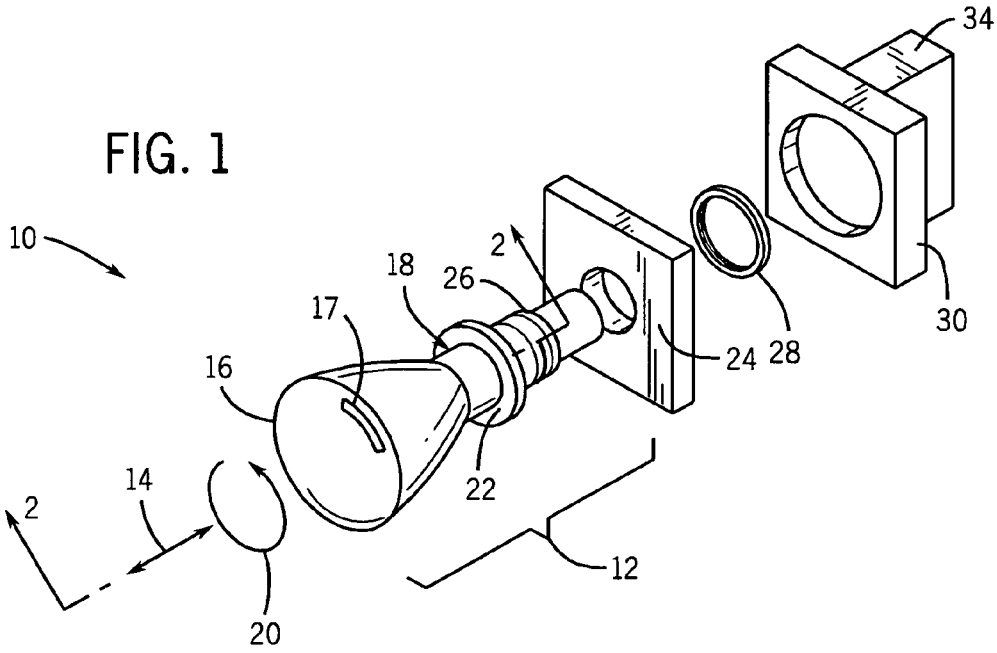
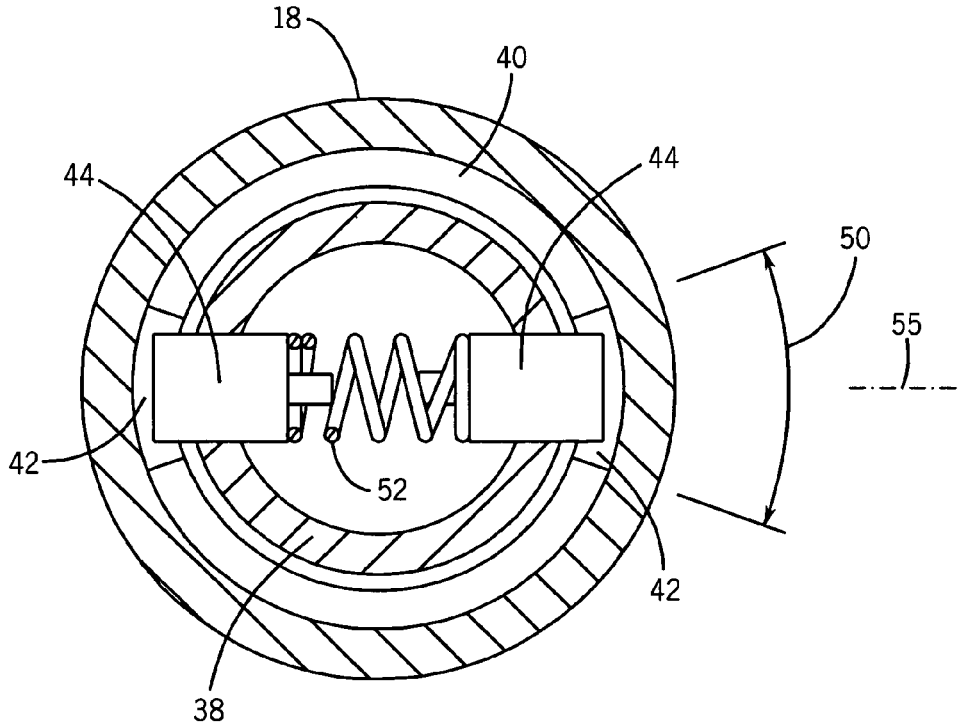
FIG. 3

PUSHBUTTON WITH REPLACEABLE MODE CAM

BACKGROUND OF THE INVENTION

The present invention relates generally to electrical pushbuttons and in particular, operators for pushbuttons that provide push-pull or twist-to-release modes of operation.

Electrical pushbuttons close or open electrical contacts in response to a pressing inward of a button or knob. Different pushbuttons may provide for different operating modes including: "momentary on", where the knob returns by spring action after it has been released, "on-off" where alternate pressings of the knob activate and deactivate the contacts, "push-pull," where pressing of the knob activates the contacts and the knob must be manually pulled to deactivate the contacts, and "twist to release," where the knob remains in when pressed until it is twisted whereupon a spring causes the knob to return. Different pushbuttons may also provide for different electrical characteristics including different numbers of contacts and whether those contacts are normally open or normally closed.

For reasons of manufacturing efficiency and inventory management, it is known in the art to provide pushbuttons that may be assembled from modular contact blocks and operators. A contact block may include a normally open or normally closed contact and the operator may include the mechanism defining the operating mode of the pushbutton. Different operators may be assembled to one or more different or identical contact blocks to provide a wide variety of different types of pushbuttons.

BRIEF SUMMARY OF THE INVENTION

The present invention provides increased modularity in the manufacture of pushbuttons by providing an operator that may be converted between push-pull and twist-to-release operating modes with the replacement of a single cam element. By standardizing the remainder of the operators, the number of parts required for manufacture and inventory is further reduced.

Specifically, the present invention provides a pushbutton operator having an operator shaft communicating with a knob. A bushing provides an axial bore guiding the operator shaft in translation along an axis and in rotation about the axis in response to a user's manipulation of the knob. A detent, including a cam element having a cam surface, and at least one spring-biased cam follower pressing against the cam surface, fits between the operator shaft and bushing so that the cam follower slides with respect to the cam surface with movement of the operator shaft in the bushing. The cam element is attached to one of the bushing and operator shaft.

It is thus one object of at least one embodiment of the invention to provide a pushbutton operator with a replaceable cam allowing different pushbutton operating modes to be realized with the same bushing and operator shaft.

The cam surface may be rotationally uniform within a rotational range of the cam follower. More specifically, the cam surface may provide a first slope with respect to the axis over a first portion of the cam surface nearest the knob and a second opposite slope with respect to the axis over a second portion of the cam surfaced furthest from the knob. The first surface provides a lower rate of movement of the cam follower with respect to translational movement of the shaft than the second surface.

It is thus another object of at least one embodiment of the invention to capture the necessary characteristics of the push-pull operating mode into a self-contained cam surface that may be replaced.

Alternatively, the cam surface may be rotationally varying within a rotational range of the cam follower. More specifically, in a first rotational position, the cam surface may provide for the slopes described above and in a second rotational position, the cam surface may provide a substantially axial slope at the second portion of the came surface furthest from the knob. In this way, the second portion of the cam surface in the first rotational position resists pulling of the knob, and in the second rotational position does not substantially resist the pulling of the knob.

It is thus another object of at least one embodiment of the invention to provide a twist-to-release operational mode of a pushbutton switch with variation of the cam surface area.

The cam may be attached to an inner wall of the bushing.

It is thus another object of at least one embodiment of the invention to provide an extremely compact pushbutton switch button operator in which the spring-loaded cam surfaces are contained within the operator shaft.

The cam element may be a ring having an outer diameter fitting within an inner diameter of the bushing.

It is thus another object of at least one embodiment of the invention to provide a cam surface that is automatically centered within the bushing bore.

The cam element may be attached to the bushing by means of axially extending barbed tabs or radially extending teeth engaging second teeth on one of the bushing and shaft with rotation of the cam element.

It is thus another object of at least one embodiment of the invention to provide a cam element that may be installed and may be replaced if it is desired later to change the operating mode of the switch.

The cam element may include two cam surfaces on opposite sides of the central axis of the bushing and may include two spring-biased cam followers pressing outward in opposite directions against respective to one of the two cam surfaces.

It is thus another object of at least one embodiment of the invention to provide for a compact cam surface that provides sufficient axial restraint on movement of the operator shaft without cross axis biasing of the operator shaft such as may unduly increase shaft to bushing friction.

The operator may be teamed with a contact block interchangeably fitting to the operator and responsive to translational movement of the operator shaft to switch electrical contacts.

It is thus another object of at least one embodiment of the invention to provide an operator that works with standard modular contact blocks to obtain the benefit thereof.

These particular objects and advantages may apply to only some embodiments falling within the claims and thus do not define the scope of the invention.

BRIEF DESCRIPTION OF THE DRAWINGS

FIG. 1 is an exploded perspective view of a pushbutton switch of the present invention showing an operator as may attach with a latch to one or more contact blocks;

FIG. 3 is a cross-sectional view of the operator and bushing of FIG. 1 taken along line 3-3 of FIG. 2 showing the cam follower engaging the cam surfaces of the cam ring and a rotational range of the operator shaft with respect to the bushing;

DETAILED DESCRIPTION OF THE PREFERRED EMBODIMENT

Figure 2:
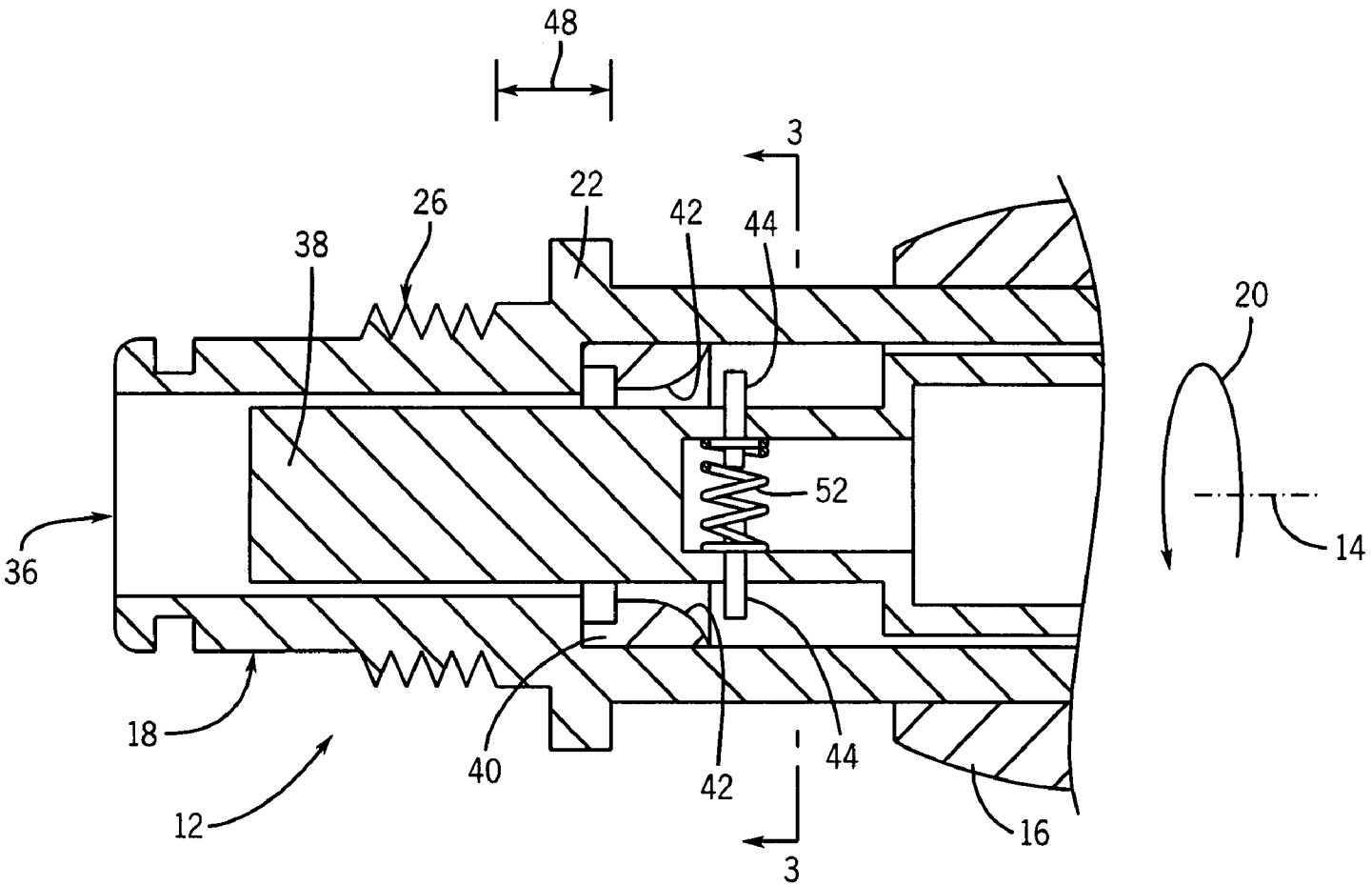
FIG. 2 is a cross-sectional fragmentary view of the operator of FIG. 1 taken along line 2-2 of FIG. 1 showing an operator shaft held within a bushing for rotational and axial movement within the operator upon manipulation of an attached knob, the operator shaft holding a spring-biased cam follower engaging a cam ring seated within the bushing.

Referring to FIG. 1, a pushbutton switch 10 may include an operator 12 having a generally cylindrical bushing 18 extending generally along axis 14.

A knob 16 at a front end of the bushing 18 provides a surface that may be pressed inward by a user along the axis 14 or pulled outward along the axis 14 or that may be twisted in rotation 20 about the axis 14. The knob 16 may include indicia 17 indicating proper use of the knob 16 and knurling or the like to allow it to be readily grasped and pushed, pulled and twisted.

The bushing 18 provides a radially extending flange 22 that may abut a front surface of a mounting panel 24 when the bushing 18 is inserted through a hole in the mounting panel 24. Threads 26 on the outside of the bushing 18 behind the flange 22 may engage a threaded mounting ring 28 that may be tightened along the threads 26 to abut the rear of the mounting panel 24 to hold the operator 12 firmly attached to the mounting panel 24 captive between the mounting ring 28 and flange 22.

A rear portion of the bushing 18 extending through the mounting panel 24 may be received by a latch 30. The latch 30 joins the operator 12 to one or more contact blocks 34 that may be activated when the knob 16 is manipulated Referring now to FIG. 2, the bushing 18 may have an axial bore 36 holding an operator shaft 38 connected to the knob 16 so that the operator shaft may be moved along axis 14 or in rotation 20 with movement of the knob 16. As is understood in the art, the knob 16 may communicate with biasing springs (not shown) including a torsion spring returning the knob 16 and operator shaft 38 to a given rotational position after the knob 16 has been twisted and a compression spring returning the knob 16 and operator shaft 38 to a given extended position after the knob 16 has been pressed inward.

Referring to FIGS. 2 and 3, attached at an inner diameter of the axial bore 36 is a cam ring 40 having opposed, inwardly-facing cam surfaces 42. The cam surfaces 42 may be engaged by opposed outwardly facing cam followers 44 extending radially from the operator shaft 38 to contact the cam surfaces 42 and slide there along as the operator shaft 38 moves translationally along the axis 14 over translation range 48 (shown in FIG. 2) or rotational range 50 (shown in FIG. 3). The cam followers 44 are biased outward by helical compression spring 52 held therebetween and are retained to move along a cross-axial axis 55 by appropriate slots in the shaft 38. Together, the cam followers 44 and cam surfaces 42 provide a detent as will be described below.

Figure 4:
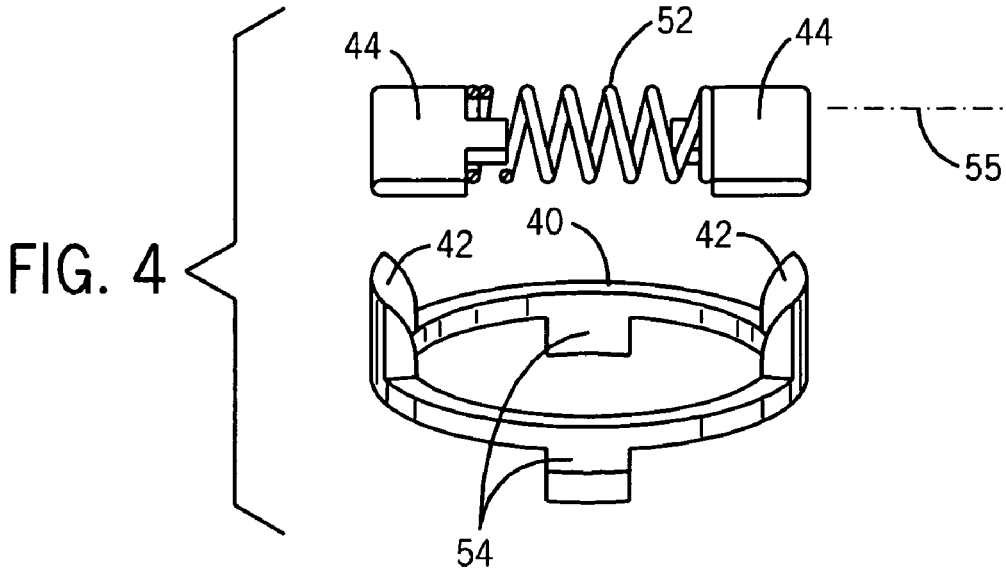
FIG. 4 is a perspective exploded view of the cam follower and bushing ring removed from the operator shaft and bushing of FIG. 2.
Figure 7:
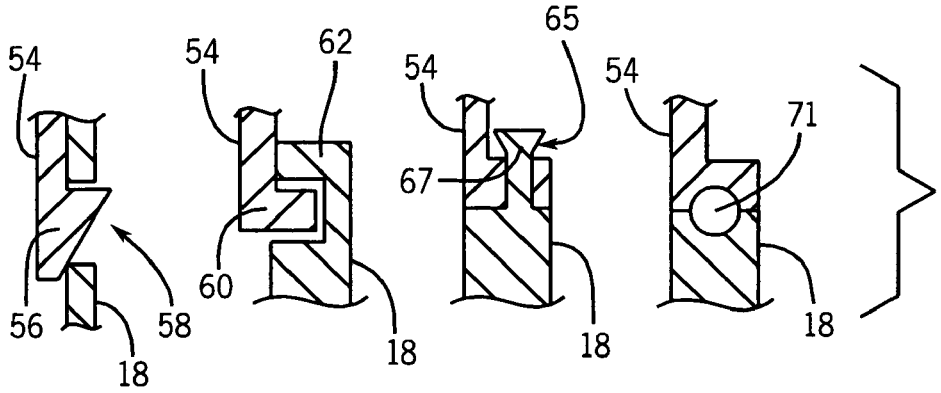
FIG. 7 is a set of fragmentary cross-sectional views of several means of attachments of the cam to the bushing by means of the downward extending tabs of FIG. 4.

Referring now to FIGS. 4 and 7, the cam ring 40 may have downwardly-extending tabs 54 providing a means of attachment of the cam ring 40 to the bushing 18. In a first attachment means shown in FIG. 4 and the left-most cross-section of FIG. 7, the downward tabs 54 terminate at barbs 56 extending radially outward to engage corresponding holes 58 in the inner wall of the bushing 18.

An alternative embodiment, shown in the second to the left cross-section of FIG. 7, multiple downward tabs 54 terminate at radially, outwardly-extending teeth 60 that may fit beneath teeth 62 extending inwardly from the inner diameter of the bushing 18. The teeth may pass axially past each other through gaps (not visible in FIG. 7) and then be rotated into engagement. These first two attachment means allow reversible attachment of the cam ring 40 to the bushing 18 allowing the operating mode of the switch 10 to be changed.

Alternatively, as shown in the third cross-section from the left of FIG. 7, a semi-permanent attachment may be made by providing an upwardly extending hole 65 in a radially extending foot at the base of the tab 54 that may receive an upwardly extending pin 67 on a shelf of the inside of the bushing 18. The portion of the pin 67 protruding through the hole 65 may be cold-staked to form a head retaining tab 54 against bushing 18.

Similarly, as shown in the fourth cross-section from the left of FIG. 7, a weld or adhesive spot 71 may be used to attach the tab 54 to the bushing 18.

Figure 5:
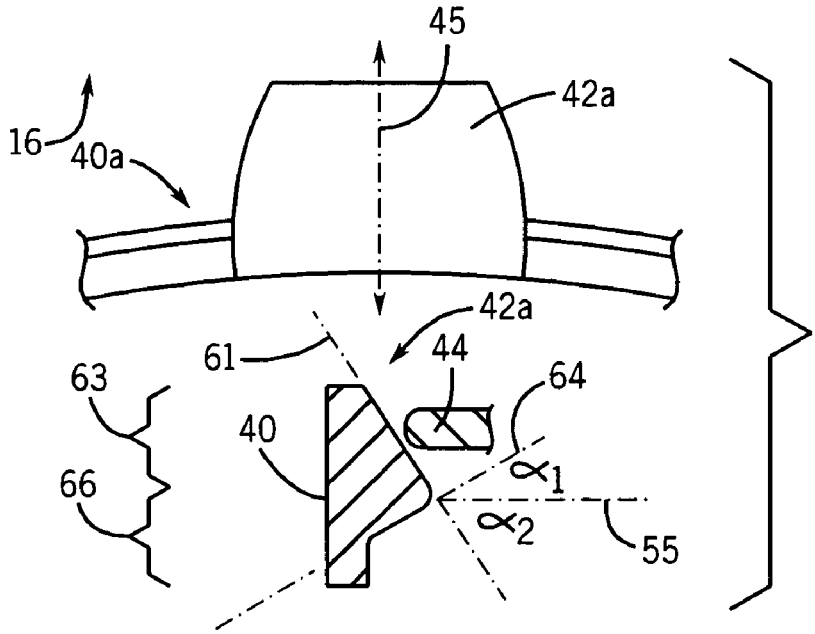
FIG. 5 is a juxtaposed elevational view of the cam surface of a first cam and a cross section of that cam surface showing two rates of slope such as control the forces resisting a pushing and pulling of the knob attached to the operator shaft.

Referring now to FIG. 5, the shape of the cam surface 42 will determine the operating mode of the switch 10. For a first cam ring 40*a* shown in FIG. 5, the cam surface 42*a* provides two different slopes with respect to cross-axis 55 along a translational path 45: a first slope 61 at a first portion 63 of the cam surface 42*a* closest to the knob 16, and a second slope 64 at a second portion 66 of the cam surface 42*a* furthest from the knob 16.

The first slope 61 provides a negative slope of $\alpha_2$ gradually pressing inward on the cam follower 44 with motion of the cam follower 44 inward with pressing of the knob 16. This first slope 61 meets a second slope 64 being a positive slope $\alpha_1$ and providing a radial outward movement of the cam follower 44 with continued inward pressing of the knob 16. Generally, $\alpha_1$ is smaller than $\alpha_2$ so as to require an increased force to pull out the knob 16 compared to the force required to push in the knob 16. This difference in force compensates for the force of the internal spring (not shown but described above) which provides outward biasing to the knob 16 and guards against accidental release of the knob 16.

Generally, the cam surface 42*a* is rotationally symmetric so that motion of the cam follower 44 is the same regardless of actual rotation of the cam follower 44 along the surface 42*a*.

Cam surface 42*a* provides a push-pull operating mode with slope 61 creating a resistance to pressing of the knob 16 caused by the force necessary to compress the cam followers 44 inward. When slope 64 is reached, outward pressing by the cam followers 44 pulls the knob 16 further inward providing for a "snap" action clearly indicating to the user that the switch 10 had been actuated. Slope 64 retains the knob 16 in its pressed state until the knob 16 is pulled sufficiently to compress the cam follower 44 inward along slope 64. When slope 61 is reached, outward pressing by the cam followers 44 pushes the knob 16 abruptly outward, signaling that the switch 10 has been deactivated.

Figure 6:
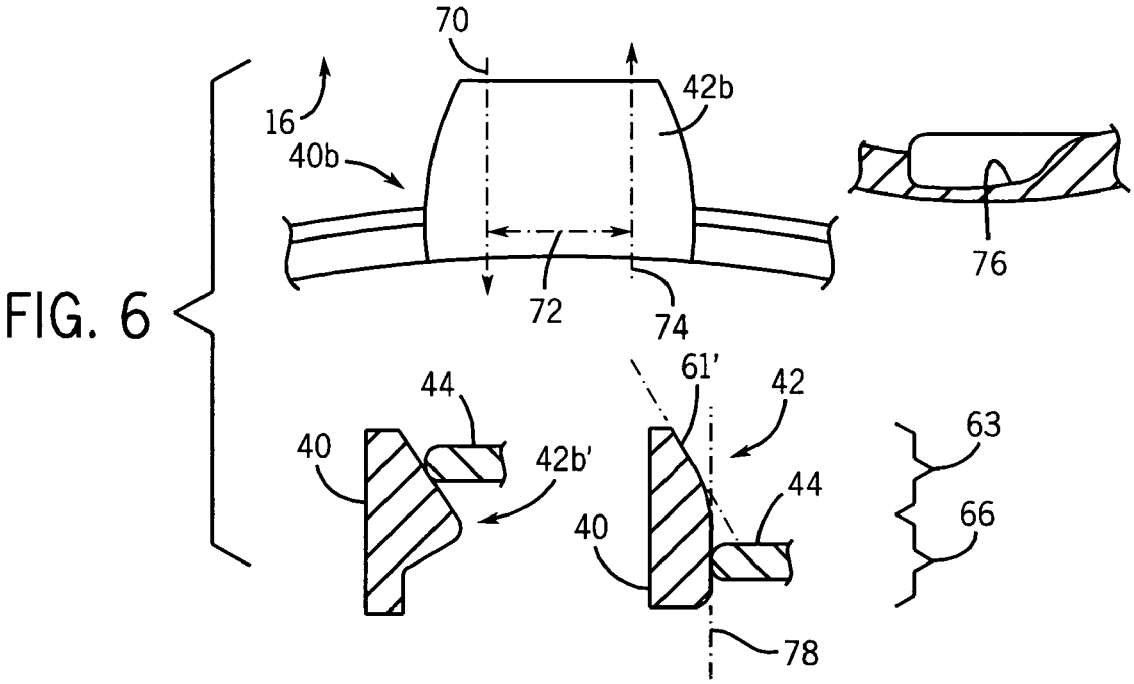
FIG. 6 is a figure similar to that of FIG. 5 showing a cam surface of a second cam and two axial cross sections for two rotational positions of the operator shaft, the first cross-section being similar to that of FIG. 5 and the second cross-section providing for release of the operator shaft under the influence of an internal spring, and further showing a third circumferential cross section of a transitional ramp between the first and second rotational positions.

Referring now to FIG. 6, the operating mode of the switch 10 may be changed to a twist to release operating mode by using a different cam ring 40*b* having a different cam surface 42*b*, but otherwise being identical to cam ring 40*a*. Referring to FIG. 6, the second cam surface 42*b* is not rotationally symmetric. Therefore, the cam follower 44 may generally follow a first axial path 70 inward when the knob 16 is pressed as rotationally biased to the left (per the Figure) by a torsion spring. Once pressed, the knob 16 may be twisted so that the cam follower 44 passes along a transverse path 72. The knob 16 may then be released to move outward with the cam follower 44 passing along a second axial path 74.

Along the first path 70, the cam follower 44 passes over a surface 42*b*' substantially similar to cam surface 42*a* described above with respect to the FIG. 5, but for possibly a steeper slope 64 that retains the cam follower 44 against being retracted by a pulling of the knob 16.

When the knob is rotated so that the cam follower 44 moves along path 72, the cam follower rides upward along a ramp 76 moving it to a surface 42*b*" having a first slope 61' identical to slope 61 of FIG. 5 over the first portion 63, but an essentially axial slope 78 at the second portion 66. This axial slope 78 allows outward movement of the cam follower 44 with relatively little resistance as there is no net compression or expansion of the cam followers 44. The knob 16 moves automatically outward once rotated under the influence of an internal spring described above.

It is specifically intended that the present invention not be limited to the embodiments and illustrations contained herein, but include modified forms of those embodiments including portions of the embodiments and combinations of elements of different embodiments as come within the scope of the following claims.

We claim:

1. A pushbutton operator comprising:

an operator shaft communicating with a knob;

a bushing providing an axial bore guiding the operator shaft in translation along an axis and in rotation about the axis in response to a user's manipulation of the knob;

a detent including a cam element having a cam surface and at least one spring biased cam follower pressing against the cam surface, the cam surface being rotationally variable within a rotational range of the cam follower and the cam follower sliding with respect to the cam surface with movement of the operator shaft in the bushing; and means for attaching the cam element to one of the bushing and operator shaft, the cam element being replaceable and operable with the detent so that the pushbutton operator may be configured as a push pull operator or a twist to release operator based on the cam element.

2. The pushbutton operator of claim 1 wherein the cam surface is rotationally uniform within a rotational range of the cam follower.

3. The pushbutton operator of claim 2 wherein the cam surface provides a first slope with respect to the axis over a first portion of the cam surface nearest the knob and a second opposite slope with respect to the axis over a second portion of the cam surface furthest from the knob; and wherein the first surface provides a lower rate of movement of the cam follower with respect to translational movement of the shaft than the second surface.

4. The pushbutton operator of claim 1 wherein the cam surface in a first rotational position provides a first slope with respect to the axis over a first portion of the cam surface nearest the knob and a second slope with respect to the axis over a second portion of the cam surface furthest from the knob;

wherein the first surface provides a lower rate of movement of the cam follower with respect to translational movement of the shaft than the second surface; and wherein the cam surface in a second rotational position provides a substantially axial surface at the second portion of the cam surface furthest from the knob;

wherein the second portion of the cam surface in the first rotational position resists pulling of the knob and in the second rotational position does not substantially resist pulling of the knob.

5. The pushbutton operator of claim 1 wherein the means for attaching the cam element attaches the cam element to an inner wall of the bushing.

6. The pushbutton operator of claim 1 wherein the means for attaching the cam element is at least one axially extending barbed tab.

7. The pushbutton operator of claim 1 wherein the means for attaching the cam element is at least one radially extending tooth engaging a second tooth on one of the bushing and shaft with rotation of the cam element.

8. The pushbutton operator of claim 1 wherein the cam element is a ring having an outer diameter fitting within an inner diameter of the bushing.

9. The pushbutton operator of claim 1 wherein the detent provides a cam element with two cam surfaces on opposite sides of a central axis of the bushing and including two spring biased cam followers pressing in opposite directions against respective ones of the two cam surface.

10. The pushbutton operator of claim 1 further including a contact block responsive to translational movement of the operator shaft to move electrical contacts.

11. A pushbutton kit comprising:

an operator shaft communicating with a knob;

a bushing providing an axial bore guiding the operator shaft in translation along an axis and in rotation about the axis in response to a user's manipulation of the knob;

at least one spring biased cam held by the shaft and pressing outward toward an inner wall of the bushing;

a first and second cam element interchangeably fitting inside the bushing providing a first and second cam surface to form a detent with a spring biased cam follower pressing against the cam surface, the cam follower sliding with respect to the cam surfaces with movement of the operator shaft in the bushing; and wherein one cam element provides a twist to release operation of the operator and the second cam element provides a push-pull operation of the operator and wherein the first cam surface is rotationally uniform within a rotational range of the cam follower, and the second surface is rotationally variable within a rotational range of the cam follower.

12. The pushbutton kit of claim 11 wherein the first cam surface provides a first slope with respect to the axis over a first portion of the cam surface nearest the knob, and a second slope with respect to the axis over a second portion of the cam surface furthest from the knob with the first surface providing a lower rate of movement of the cam follower with respect to translational movement of the shaft than the second surface; and wherein the second cam surface in a first rotational position provides a first slope with respect to the axis over a first portion of the cam surface nearest the knob and a second slope with respect to the axis over a second portion of the cam surface furthest from the knob, the first surfacing provides a lower rate of movement of the cam follower with respect to translational movement of the shaft than the second surface;

and wherein the second cam surface in a second rotational position provides a substantially axial surface at the second portion of the cam surface furthest from the knob.

13. The pushbutton kit of claim 11 wherein the cam element is attached to the bushing with least one axially extending barbed tab.

14. The pushbutton kit of claim 11 wherein the cam element is attached to the bushing with least one radially extending tooth engaging a second tooth on one of the bushing and shaft with rotation of the cam element.

15. The pushbutton kit of claim 11 wherein the detent provides a cam element with two cam surfaces on opposite sides of a central axis of the bushing and including two spring biased cam followers pressing in opposite directions against respective ones of the two cam surfaces.

16. The pushbutton kit of claim 11 further including a set of contact blocks interchangeably fitting to the operator and responsive to translational movement of the operator shaft to move electrical contacts.

17. A pushbutton operator comprising:

an operator shaft communicating with a knob;

a bushing providing an axial bore guiding the operator shaft in translation along an axis and in rotation about the axis in response to a user's manipulation of the knob;

a detent including a cam element having a cam surface and at least one spring biased cam follower pressing against the cam surface, the cam follower sliding with respect to the cam surface with movement of the operator shaft in the bushing; and means for attaching the cam element to an inner wall of the bushing, the cam element being replaceable and operable with the detent so that the pushbutton operator may be configured as a push pull operator or a twist to release operator based on the cam element.

18. A pushbutton operator comprising:

an operator shaft communicating with a knob;

a bushing providing an axial bore guiding the operator shaft in translation along an axis and in rotation about the axis in response to a user's manipulation of the knob;

a detent including a cam element having a cam surface and at least one spring biased cam follower pressing against the cam surface, the cam follower sliding with respect to the cam surface with movement of the operator shaft in the bushing and the cam element being a ring having an outer diameter fitting within an inner diameter of the bushing; and means for attaching the cam element to one of the bushing and operator shaft, the cam element being replaceable and operable with the detent so that the pushbutton operator may be configured as a push pull operator or a twist to release operator based on the cam element.

* * * * *